US008601959B2

(12) United States Patent
His et al.

(10) Patent No.: US 8,601,959 B2
(45) Date of Patent: Dec. 10, 2013

(54) REFRACTORY TILE, IN PARTICULAR FOR A GASIFIER

(75) Inventors: Christian Claude His, Cavaillon (FR); Thibault Pierre Paul Champion, Cheval Blanc (FR); Franceline Marguerite Louise Villermaux, Avignon (FR)

(73) Assignee: Saint-Gobain Centre de Recherches et d'Etudes Europeen, Courbevoie (FR)

( * ) Notice: Subject to any disclaimer, the term of this patent is extended or adjusted under 35 U.S.C. 154(b) by 1536 days.

(21) Appl. No.: 11/908,005

(22) PCT Filed: Mar. 6, 2006

(86) PCT No.: PCT/FR2006/000501

§ 371 (c)(1),
(2), (4) Date: Nov. 27, 2007

(87) PCT Pub. No.: WO2006/095081

PCT Pub. Date: Sep. 14, 2006

(65) Prior Publication Data

US 2008/0163806 A1 Jul. 10, 2008

(30) Foreign Application Priority Data

Mar. 7, 2005 (FR) ..... 05 02272

(51) Int. Cl.
*F23M 5/02* (2006.01)

(52) U.S. Cl.
USPC ..... 110/325; 52/506.02

(58) Field of Classification Search
USPC ..... 110/322, 323, 324, 325, 338, 339; 432/234; 52/506.02, 506.06
See application file for complete search history.

(56) References Cited

U.S. PATENT DOCUMENTS

| | | | | |
|---|---|---|---|---|
| 4,453,475 | A * | 6/1984 | Ploger | 110/339 |
| 4,768,447 | A * | 9/1988 | Roumeguere | 110/336 |
| 5,966,886 | A * | 10/1999 | Di Loreto | 52/506.02 |
| 6,267,066 | B1 * | 7/2001 | Schickling et al. | 110/336 |
| 6,487,980 | B2 * | 12/2002 | Wilhelmi et al. | 110/336 |

FOREIGN PATENT DOCUMENTS

| | | | | |
|---|---|---|---|---|
| GB | 2234051 | | 1/1991 | |
| GB | 2234051 | A * | 1/1991 | F27D 1/04 |

* cited by examiner

*Primary Examiner* — Kenneth Rinehart
*Assistant Examiner* — David J Laux
(74) *Attorney, Agent, or Firm* — Young & Thompson

(57) ABSTRACT

In a refractory tile, at least two fixing points are aligned, any two adjacent fixing points of the alignment being spaced by a constant distance A, first (44) and last (46) fixing points of the alignment being separated, in the direction of the alignment, by distances $\alpha_1$ and $\alpha_2$ from first (40) and second (42) edges of the tile extending proximate the first (44) and second (46) fixing points respectively. The tile is characterized in that $0<A-(\alpha_1+\alpha_2)$. Application to gasifiers.

25 Claims, 6 Drawing Sheets

REFRACTORY TILE, IN PARTICULAR FOR A GASIFIER

FIELD OF THE INVENTION

The invention relates to a refractory tile for fixing to a wall of a reactor, in particular to protect that wall from heat.

BACKGROUND OF THE INVENTION

Refractory tiles are used to line the walls of combustion chamber tubes in boilers for incinerating biomass or domestic refuse. The tubes are usually vertical and connected together by cross-bars. The tiles form a refractory lining, protecting the tubes from physical contact with materials during their combustion and with the fumes from that combustion. Thin tiles facilitate heat transfer from the reactor to a fluid flowing in the tubes of the boiler.

Water flows in the tubes to recover part of the heat released during incineration. Close contact between the tiles and the tubes is thus desirable. To this end, as described, for example, in European patent EP-1 032 790, the rear face of each tile conventionally has semi-cylindrical channels shaped so that each receives a tube of the wall of tubes. A thin layer of liquid mortar may also be disposed behind the tiles to limit the volume of the void between the tiles and the tubes, and thus improve heat exchange.

Using floating tiles hung on the wall provides the tiles with a certain degree of mobility relative to one another. To this end, the tiles may, for example, be freely hung on hooks fixed to the middles of bars, and the tiles may be spaced from each other by a few millimeters. The protective lining can thus adapt itself to dimensional variations in the tiles during thermal cycles. The reliability of the lining is thus improved.

The expansion space between two adjacent tiles is generally filled with a flexible mortar to guarantee a seal for the lining. Flexible mortar expansion joints are vulnerable zones and their length must thus be minimized. Conventionally, then, each tile extends over a plurality of tubes. To facilitate positioning of the lining, the dimensions of the tiles must, however, be limited. As an example, the tiles described in EP-1 032 790 extend over three tubes. They include two slots extending either side of a central channel and intended to receive fixing means.

Two types of assembly are possible with the system described in EP-1 032 790.

In a first type of assembly, the hooks are mounted to allow the tiles to be assembled in a pattern that is staggered in the vertical or horizontal direction. Depending on the selected configuration, such an assembly prevents the vertical or horizontal joints from aligning. In practice, that type of assembly proves to be complex and a source of problems. Further, it takes a long time to produce and thus costs are high.

In the second type of assembly, the hooks are disposed in vertical and horizontal lines. However, the configuration of the tiles implies that the spacing of the lines of hooks must vary, which results in an alignment of vertical and horizontal joints. The inventors have found that such an alignment reduces the durability of the joints and thus of the lining.

Further, there are occasional obstacles, for example those formed by passages for thermocouples, which require the assembly to be modified. In particular, it may be necessary to offset one or more rows of hooks, which is an expensive operation. It is also possible to cut one or more tiles. However, cutting inevitably weakens the cut part when in service.

Thus, there is a need for a refractory lining comprising refractory tiles, which lining is easy to use, in particular to accommodate the presence of obstacles, and has improved reliability.

The invention aims to satisfy that need.

SUMMARY OF THE INVENTION

In accordance with the invention, that aim is achieved by a refractory tile, notably for protecting the inner wall of a gasifier reactor, said tile having an alignment of at least two fixing points, any two adjacent fixing points of said alignment being spaced by a constant distance A, the first and last fixing points of said alignment being separated, in the direction of said alignment, by distances $\alpha_1$ and $\alpha_2$ from first and second edges of said tile extending in the proximity of said first and last fixing points respectively. The tile of the invention is characterized in that $0<A-(\alpha_1+\alpha_2)$.

When the distance $D=A-(\alpha_1+\alpha_2)$ corresponds to the width $e_l$ of the vertical expansion joints, the fixing means of a row of tiles are then regularly spaced by the length A. In other words, the horizontal distance between two fixing means side by side is identical, regardless of whether these means are intended to support one tile or two adjacent tiles. Thus, it is possible to offset a row of tiles horizontally by the distance A or by any multiple of that distance. Similarly, when the distance D corresponds to the width $e_h$ of the horizontal expansion joints, it is possible to offset a row of tiles vertically by the distance separating two superimposed fixing points of the tile, or by any multiple of that distance.

Adapting the tile assembly to accommodate the presence of an obstacle may then be the result of simply offsetting the tiles horizontally and/or vertically. Further, it is possible to offset the tiles of two superimposed rows and/or two adjacent columns to remove any continuous alignment of vertical and/or horizontal joints. The reliability of the joints and thus of the lining is advantageously improved thereby.

Preferably, the tile of the invention also exhibits one or more of the following optional characteristics:

- in a service position of the tile, i.e. in a position in which it is fixed to a wall, said alignment is vertical or horizontal;
- the fixing points are shaped to allow floating fixing of the tile, i.e. with a functional tolerance, if possible in three dimensions. Preferably, the fixing points are slots;
- $A-(\alpha_1+\alpha_2)$ is in the range 2 millimeters (mm) to 10 mm. Advantageously, an expansion space can thus be provided between two tiles;
- the tile includes at least one slot opening exclusively onto a rear face of said tile;
- the tile includes at least one slot opening via a lower opening on a lower edge of said tile, and at least one tongue that can be at least partially introduced via a lower opening of a slot of another identical tile. Preferably, the tile has as many said tongues as it has slots;
- on a rear face, the tile has at least one spacer that preferably extends over only a portion of the height H of the tile. Preferably, the spacer does not extend to the lower edge of said rear face;
- the upper and lower edges of the tile have upper and lower lips extending respectively to prolong the front and rear faces of the tile;
- the tile has a generally curved shape, preferably slightly cylindrical; and
- the tile is formed from a material comprising at least 60%, as a percentage by weight, of non-siliceous oxides and/or at least 1% by weight of silica ($SiO_2$).

The invention also provides a refractory lining, in particular for protecting the inner wall of a reactor of a gasifier, the lining comprising an assembly of refractory tiles attached to fixing means fixed to a wall, and being characterized in that said lining comprises at least one tile in accordance with the invention.

Preferably, the refractory lining of the invention also has one or more of the following optional characteristics:

- at least one tile of the assembly has a horizontal alignment of at least two fixing points, any two adjacent fixing points of the alignment being spaced by a constant distance A, the first and second fixing points of said alignment being spaced in the horizontal direction by distances $\alpha_1$ and $\alpha_2$ from the right and left edges of said tile respectively, such that $0<A-(\alpha_1+\alpha_2)$, and said tile being spaced from at least one tile disposed to its right or its left by a distance $e_l$ equal to $A-(\alpha_1+\alpha_2)$. A discontinuity in the vertical joints is thus made possible by offsetting one row of tiles horizontally relative to another row adjacent thereto;
- at least one tile has a vertical alignment of at least two fixing points, any two adjacent fixing points of the alignment being spaced by a constant distance A', the first and last fixing points of said alignment being spaced in the vertical direction by distances $\alpha_1'$ and $\alpha_2'$ from the upper and lower edges of said tile respectively, such that $0<A'-(\alpha_1'+\alpha_2')$, and said tile being spaced from at least one tile disposed above or below it by a distance $e_h$ equal to $A'-(\alpha_1'+\alpha_2')$. A discontinuity in the horizontal joints is thus made possible by offsetting one "column" of tiles vertically relative to another column of tiles adjacent thereto;
- the distances $e_l$ and $e_h$ are substantially equal and are preferably in the range 2 mm to 10 mm;
- a castable refractory concrete is disposed along the rear faces of the tiles of the assembly;
- the castable concrete is reinforced with fibers, preferably metal fibers;
- a grid, preferably a metal or non organic fiber grid, is embedded in said castable concrete;
- the fixing means are aligned along substantially vertical and/or horizontal lines regularly spaced by said distance A; and
- at least a portion of the tiles are mounted in a vertical or horizontal staggered pattern, preferably a vertical and horizontal staggered pattern.

The lining of the invention is particularly for the protection of a wall of a gasifier reactor.

Coal gasification is a process that has been known for about half a century and that is currently developing rapidly. It can produce synthesis gas (CO, $H_2$), a clean energy source, and also base compounds for the chemicals industry starting from highly diverse hydrocarbon materials, for example coal, oil coke, or even heavy oils for recycling. That process can also eliminate unwanted components, for example $NO_x$, sulfur or mercury, before being discharged into the atmosphere.

The principle of gasification consists in controlled partial combustion in steam and/or oxygen at a temperature in the range about 1150° C. to 1600° C., and under pressure.

Different types of gasifier exist, using a fixed, fluidized, or entrained bed. Such gasifiers differ in the way in which the reagents are introduced, the manner in which the fuel-oxidizer mixture is produced, the temperature and pressure conditions, and the method of evacuating ash or slurry, the liquid residue from the reaction.

In particular, a pressurized dry gasifier 5 is known, with a fluidized bed, of the "Lurgi fixed bed dry ash gasifier" type. As can be seen in FIG. 1, coal C in lumps enters the gasifier at the top 10 and is introduced into a reactor 14 via a feed device 12. Steam, $H_2O$, and oxygen, $O_2$, enter via the lower portion 16 of the gasifier 5 and react with the coal C as they rise in the reactor 14. In the lower portion of the reactor 14, the temperature is about 1600° C. In the upper portion 18 of the reactor 14, the temperature is about 450° C. to 900° C. Ash D is removed from the base of the gasifier 5. The synthesized gas G escapes via an outlet 20.

The dry coal gasifier reactor 14 comprises a water jacket 22 formed from steel. The jacket 22 comprises an outer wall 24 and an inner wall 26, the site of a great deal of corrosion, which at least partially defines the internal volume of the reactor 14. Said reactor has a limited service life due to thermal cycles and/or corrosion and/or abrasion by the dry ash and/or hot points where the temperature is typically about 1400° C.

The tiles of the invention are particularly suitable for protecting the wall of a gasifier reactor, said wall not being constituted by tubes. Preferably, the refractory tiles are fixed by hanging them on fixing means fixed to said wall. The protective lining obtained is advantageously compact, reliable, and easy to position, as appears in greater detail in the description below.

Finally, the invention provides a method of determining the overall thermal conductivity of a lining of a wall of a reactor, the lining comprising an assembly of refractory tiles, the method being characterized in that concrete with predetermined conductivity is cast between the assembly of tiles and said wall.

BRIEF DESCRIPTION OF THE DRAWINGS

Other characteristics and advantages of the invention become apparent from the following description and the drawings in which.

DETAILED DESCRIPTION OF EMBODIMENTS

Figure 1:
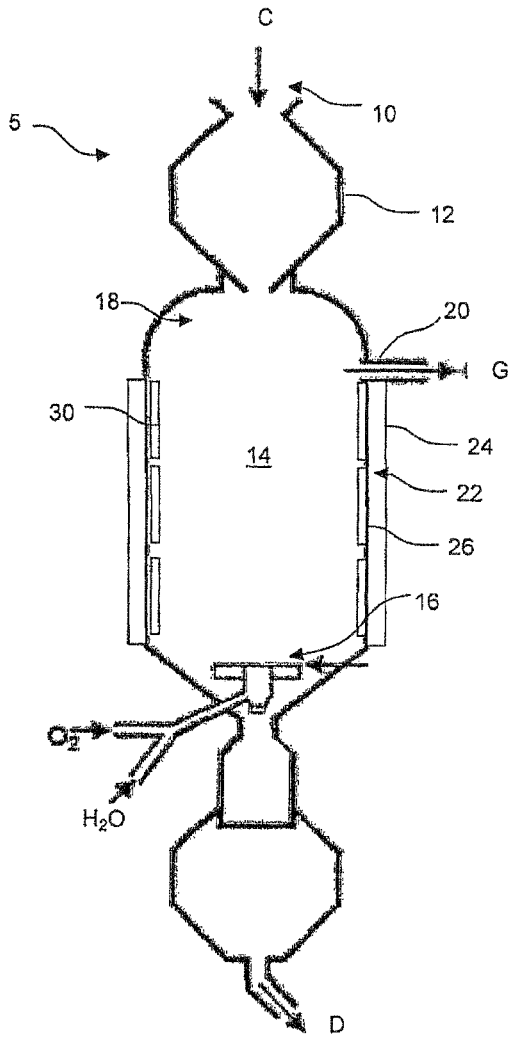
FIG. 1 is a sectional diagrammatic representation of a Lurgi type gasifier.

In the various figures, identical or analogous reference numerals are used to designate identical or analogous parts or portions.

Since FIG. 1 is described above, reference is now made to FIG. 2.

The description below is made in the context of a lining for the gasifier described above. However, the invention is not limited to that application.

A tile 30 has the general shape of a cylindrical rectangle, having a small amount of curvature to follow the shape of the inner wall of the jacket 22 of the reactor 14.

Preferably, the tile 30 is made of a thermally insulating material. Preferably, that material comprises at least 60%, more preferably at least 90%, and still more preferably at least 99%, as a percentage by weight, of non-siliceous oxides. Preferably, said non-siliceous oxides are selected from alumina, zirconia, chromium oxide $Cr_2O_3$, or mixtures thereof. However, any other refractory material that can resist corrosion by ash (which may be molten), abrasion by dry ash, and by hot points could be used.

Preferably, the material of the tile of the invention contains no silicon carbide (SiC). Preferably again, it includes less than 1%, more preferably less than 0.5% by weight of silica ($SiO_2$). Silicon carbide and silica have a deleterious effect on corrosion resistance. Further, silica may be unstable and evaporate in the form of SiO, or even $SiH_4$.

The tile 30 has a front face 32 and a rear face 34 and an upper edge 36, lower edge 38, right edge 40 and left edge 42.

The rear face 34 or "cold face" of the floating tile 30 includes first 44 and second 46 slots extending substantially parallel to the side edges 40 and 42 along the right 40 and left 42 edges respectively. The slots 44 and 46 open via first 48 and second 50 lower openings respectively to the lower edge 38, and via first 52 and second 54 rear openings respectively to the rear face 34.

The face 32 or the "hot face" and the face 34 or the "cold face" of the floating tile 30, are curved substantially to follow the curvature of the reactor.

Figure 2:
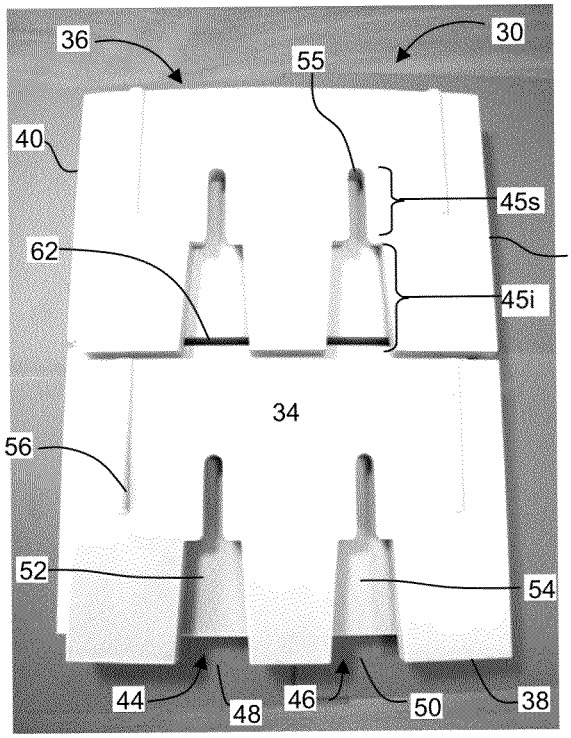
FIGS. 2 and 3 are respective photographs of the rear and front faces of two tiles in accordance with the invention; the photographs are positioned as the tiles would be positioned in a reactor assembly; the top of the page represents the top of the assembly.
Figure 3:
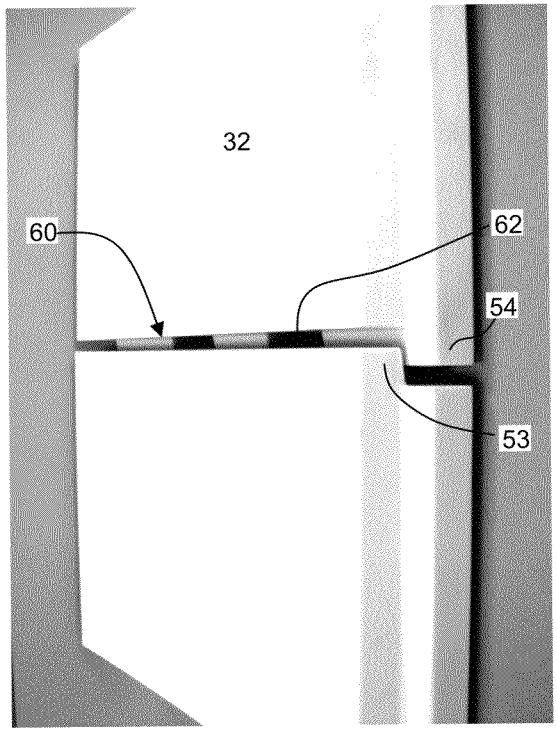
Figure 4:
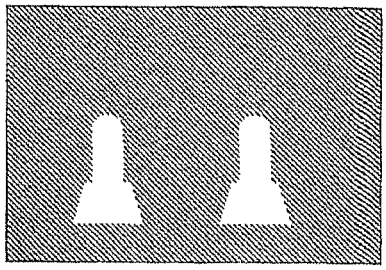
FIGS. 4 to 8 are diagrammatic views of the rear faces of different tiles in accordance with the invention.

As can be seen in FIGS. 2 and 3, the upper 36 and lower 38 edges exhibit upper 53 and lower 54 lips to overlap the lower edge 38 of one tile by the upper edge 36 of another tile disposed immediately above it. Similarly, the right 40 and left 42 edges exhibit lips allowing the right edge 40 of one tile to be overlapped by the left edge 42 of another adjacent tile. The overlap lips prevent the cooling jacket from being exposed during movement of the tiles relative to each other. Advantageously, protection of the jacket 22 is thereby improved.

As is described in more detail in the description below, the tile 30 can be hung on a fixing means having the general form of a nail and comprising a shank and a head. After hanging, the bottom of the slot rests under gravity on the head of the fixing means which then supports the weight of the tile.

Viewed from the rear of the tile as shown in FIG. 2, a rear opening of a slot 45 has a narrow upper portion 45*s* extending to a bottom 55 of the slot 45. The slot 45 is shaped to allow a shank of a T-shaped fixing means to slide in the upper portion 45*s*, but not to allow the head of that fixing means to pass through axially. For this reason, the cross section of the upper portion 45*s* is preferably omega-shaped. After hanging the tile, this type of profile advantageously prevents the head from escaping via the rear opening of the tile, and thus prevents the tile from swinging and accidentally unhooking.

A rear opening also preferably has a wide lower portion 45*i* for introducing a head of a fixing means. Advantageously, this head may thus be introduced into the slot 45 via a lower opening or via a lower portion of a rear opening.

The rear face 34 of the tile 30 also has crosspieces or "spacers" 56 that are preferably shaped to maintain a distance in the range 2 mm to 5 mm between the rear face of the tile and the inner wall 26 of the cooling jacket. Advantageously, the distance of the tiles from the wall governs heat exchange.

The presence of a plurality of slots per tile, preferably two, advantageously guarantees that the tile stays in position if one of the fixing points fails.

As can be seen in FIG. 3, an expansion space 60 is provided between two adjacent tiles. This expansion space 60, however, allows direct access to the rear face of the tiles. The lower openings on the lower edges of the tiles are not covered by the overlap lips of the tiles and thus leave a direct passage 63 from the interior of the reactor 14 through to the inner wall 26 of the cooling jacket, which passage is available to gases or other aggressive agents.

FIGS. 4 to 8 show tile forms exhibiting two horizontally aligned slots that advantageously have the common characteristic of being shaped and/or assembled to seal off any direct access to the rear face of the tiles via the slots. It can thus be seen that before interposing any expansion joint between two tiles, no passages pass through the assembly of tiles in a substantially rectilinear manner, in particular by extending perpendicularly to the front faces of the tiles, and which could thus place the rear of the tiles in communication with the internal volume of the reactor.

As can be seen below, it is preferable to provide a castable concrete behind the tiles, in particular to bond them to the cooling jacket 22. Blocking communication between the rear and front faces of the tiles also has the advantage of preventing the concrete from flowing into the expansion spaces 60 during installation. If it did flow therein, the tiles could no longer expand during operation of the gasifier without expansion generating high, unwanted thermomechanical stresses.

The disposition of the upper lip 53 in the extension of the front face of a tile allows an enlarged opening to be formed to access the rear of the tile. Advantageously, this facilitates casting of concrete behind that tile.

Figure 5:
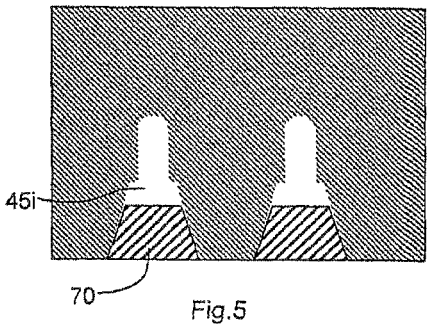
Figure 7:
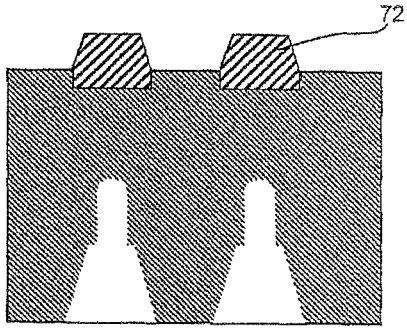
Figure 8:
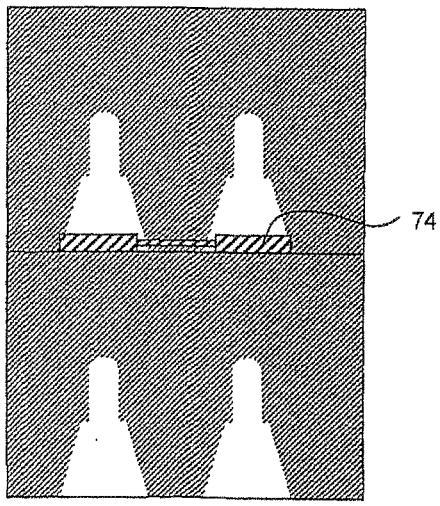

In a first variation (FIGS. 4 and 5), the slots 45 do not open into the lower edge of the tile 30, i.e. the slots 45 are in the form of holes that open only to the rear face of the tile. A slot that does not open onto the lower edge of the tile may be formed by assembling a plug 70, for example by adhesive bonding, to plug its lower opening onto the lower edge, as shown in FIG. 5. Advantageously, it is then possible to use tiles as shown in FIG. 2. A slot that does not open onto the lower edge may also be cast along with the tile during its manufacture.

The lower portion 45*i* of a slot that does not open onto the lower edge of the tile must necessarily be shaped to allow a head of a fixing means to be introduced; this head cannot be introduced via the lower edge.

In a second variation (FIGS. 6 and 7), the tile includes tongues 72 that can be embedded in corresponding slots of another identical tile.

Figure 6:
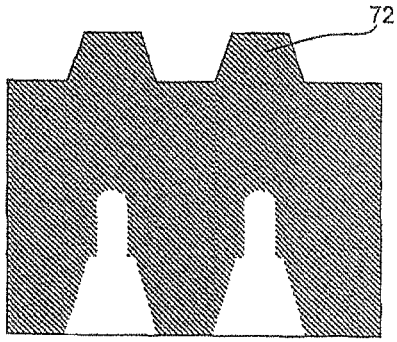

Preferably, the tile has as many tongues as it has slots, so that when assembling an upper tile immediately above a lower tile, all of the lower openings of the slots of the upper tile are hidden by the tongues of the lower tile. This characteristic may be obtained by assembling tongues on an existing tile, for example by adhesive bonding (FIG. 7), or by shaping tongues during manufacture of the tile (FIG. 6).

In a third variation (FIG. 8), a plug 74, which preferably has the same composition as the tiles, is inserted between the tiles after they have been assembled to block any direct access to the rear face of the tiles via the slots, while preserving an expansion joint. Preferably, the plug 74 has the same refractory composition as the tiles.

Preferably, all of the slots of all of the tiles of the assembly are hidden by using at least one of the solutions illustrated in FIGS. 4 to 8.

Figure 9:
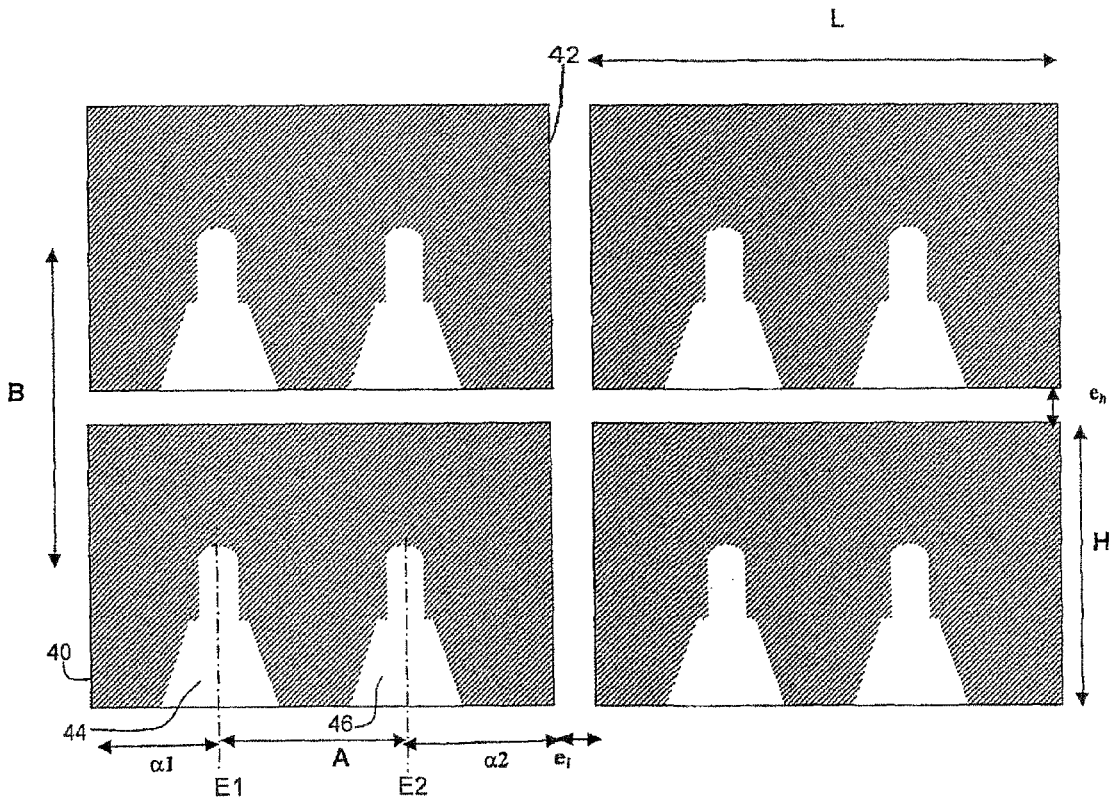
FIG. 9 is a diagrammatic view of the rear faces of an assembly of four tiles in accordance with the invention.

As can be seen in FIG. 9, the distance A between the axes E1 and E2 of the slots 44 and 46 is less than the sum of the distances $\alpha_1$ and $\alpha_2$ separating these axes E1 and E2 from the right 40 and left 42 edges respectively. In other words:

$$0<e_l=A-(\alpha_1+\alpha_2).$$

More generally, if the tile has "n" slots regularly spaced by a distance $A_n$, then in accordance with the invention:

$$0<e_l=A_n-(\alpha_1+\alpha_2).$$

Preferably, $e_l$ is in the range 2 mm to 10 mm.

Since the edges of the tile 30 are not planar, $\alpha_1$ and $\alpha_2$ are measured on the rear face of the tile. This is also applies to the length L of the tile and to its height H.

Figure 10:
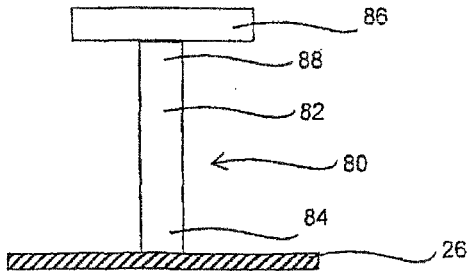
FIG. 10 shows a fixing means that can be used to fix the tiles of an assembly of the invention.

FIG. 10 shows a fixing means 80 comprising a threaded shank 82, one end 84 of which is welded to the inner wall 26 of the jacket 22. A head or "washer" 86 is screwed onto the second end 88 of the shank 82.

Clearance is provided between the head 86 and the slot 45 so that the fixing means 80 do not interfere with expansion of the tile 30.

In the prior art, the fixing means 80 of the type shown in FIG. 10 are welded to the inner wall 26 of the jacket 22, substantially perpendicularly to the wall 26 (FIG. 10). They are aligned in substantially vertical and horizontal lines Lv and Lh. The distance F between two adjacent vertical lines Lv is not constant and depends on the tiles used, as can be seen in FIG. 11.

Figure 11:
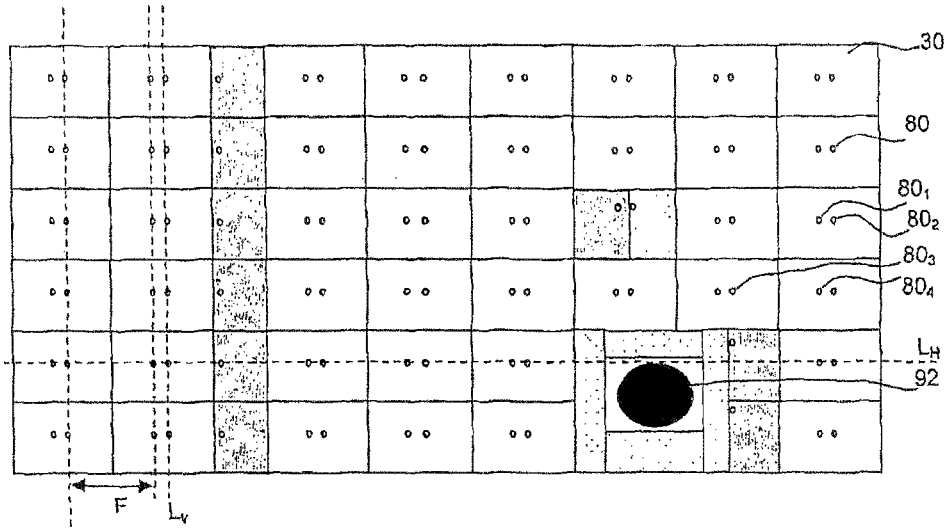
FIG. 11 is a front view of an assembly of prior art tiles. This assembly is cylindrical and is shown in a developed form.

When used in a gasifier reactor, installation of an irregular array of fixing means 80 as shown in FIG. 11 has several drawbacks. Firstly, it may result in errors when positioning the fixing means. Three gauges are required to guarantee correct vertical spacing of the fixing means, correct horizontal spacing of fixing means $\mathbf{80}_1$ and $\mathbf{80}_2$ intended to receive two slots of the same tile, and correct horizontal spacing of the fixing means $\mathbf{80}_3$ and $\mathbf{80}_4$ intended to receive two slots of two different adjacent tiles. Further, all of the connections between two "columns" of tiles must necessarily be located on the same vertical. In particular, the tiles cannot be mounted in a staggered pattern. This causes the lining to be heterogeneous and fragile.

In contrast to the disposition of the fixing means shown in FIG. 11, the fixing means 80 are preferably aligned in substantially vertical lines Lv that are regularly spaced by a distance A, i.e. the distance A separating the axes E1 and E2 of the slots of a tile.

The fixing means are also aligned in substantially horizontal lines regularly spaced by a distance B. Preferably, the distance B is greater than the height H of a tile, i.e. $0<e_h=B-H$.

The term "spacing" when applied to two tiles does not means that those two tiles do not touch, but that in the direction under consideration, relative displacement of one tile relative to the other is possible. Thus the spacing $e_l$ of two tiles in the width direction means that one tile may expand laterally by a distance $e_l$ before abutting against the tile to its side. The spacing $e_h$ in the height direction of two tiles means that one tile may expand upwards or downwards by a distance $e_h$ before abutting against the tile above or below it.

Preferably, the distance B is equal to the distance A. The same gauge can thus be used to provide the correct vertical and horizontal spacings.

Since $e_l+(\alpha_1+\alpha_2)=A$, the same gauge can be used to check the spacing of two fixing means $\mathbf{80}_1$ and $\mathbf{80}_2$ side by side and intended to receive the same tile, and to check the spacing of two fixing means $\mathbf{80}_3$, $\mathbf{80}_4$ side by side and intended to receive different tiles. A single gauge can thus advantageously be used to position all of the fixing means.

Further, the way the tiles are assembled is not "frozen" by the positioning of the fixing means; a row of tiles may, for example, be laterally offset by a length corresponding to the spacing between two slots of a tile if necessary. In contrast to the prior art, a half tile may thus readily be incorporated even after the fixing means have been welded into place.

It is thus possible to mount the tiles in a staggered pattern to reinforce the protection offered by the refractory lining, to readily incorporate a passage for a thermocouple embedded in a filler concrete 90, or to accommodate a damaged surface, having an opening or a hole 92, for example, with a great deal of flexibility.

Figure 12:
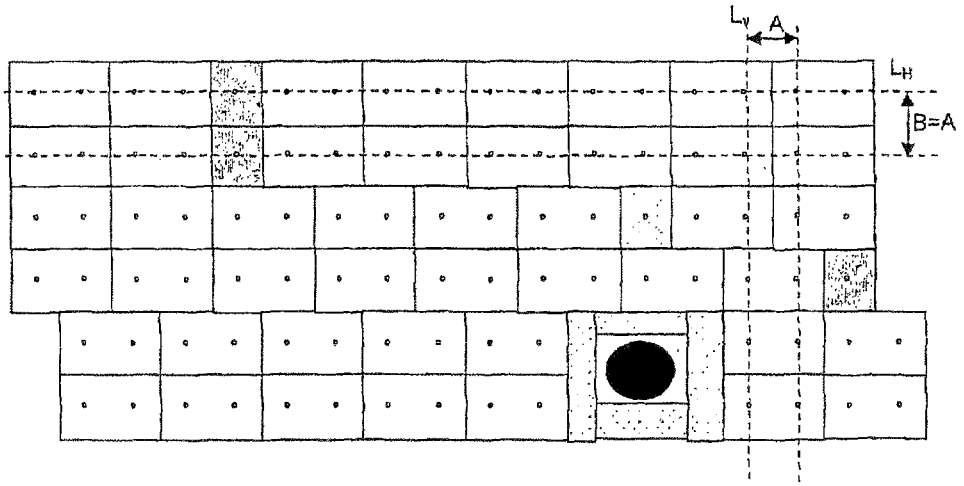
FIG. 12 is a front view of an assembly of tiles of the same format in accordance with the invention. This assembly is cylindrical and is shown in a developed form.

A comparison of the tile assemblies of FIGS. 11 and 12 shows that the assembly of FIG. 12 requires three tiles to be cut while that of FIG. 11 requires nine.

Before hanging on the tiles, a grid, preferably a metal or non organic fiber grid, is preferably hung on the fixing means.

The tiles are then hung on the fixing means 80 by inserting the fixing means in the slots 45. Preferably, the tiles are of the type shown in FIGS. 4 to 8. With the tiles of FIG. 8, the plugs 74 may be positioned while the tiles are being assembled, or after all of the tiles have been hung.

The heads 86 are dimensioned to allow the fixing means 80 to be inserted into the bottoms 55 of the slots, while preventing disengagement via the upper portions 45*s* of the rear openings of the slots, which are partially closed because of their omega, Ω, shape.

The fixing means 80 thus serve not only to support the weight of the tiles (acting as a bracket), but also to prevent the tiles from swinging by holding them substantially flat against the wall 26.

The order in which the tiles are hung up depends on the profiles of their edges. It is determined so that adjacent tiles overlap, as envisaged by the tile manufacturer.

In accordance with the invention, a castable concrete is preferably cast into the space separating the tiles and the inner wall of the cooling jacket. This space is guaranteed by the presence of spacers 56 bearing on the wall 26. Advantageously, the spacers 56 prevent direct contact between the rear faces of the tiles and the wall, and thus improve the thermal protection of the wall.

Since the spacers 56 extend over only part of the height of said tile, they do not impede the movement of concrete behind the tile.

Advantageously, the concrete can thus be distributed uniformly behind the tiles.

Preferably, the castable concrete is based on $Al_2O_3$ or $Al_2O_3$—$Cr_2O_3$ or has a nature similar to the tiles.

The castable concrete can advantageously regulate the overall conductivity of the lining by its nature and its thickness. Its composition can be modified as a consequence. As an example, a castable concrete based on SiC or enriched with metal or ceramic fibers, for example of the Dramix® or Unifrax type, may advantageously be used if necessary to increase the thermal conductivity of the lining, i.e. to increase the transfer of heat to the cooling jacket, in particular to produce the steam necessary for the gasifier system.

The castable concrete may also protect the inner wall 26 of the cooling jacket if a tile becomes unhooked.

It also helps the tiles to withstand the pressure of several tens of bars reigning inside the reactor in operation.

Finally, it blocks any direct access to the rear faces of the tiles and thus to the metal wall 26 of the cooling jacket.

In the event of a tile unhooking by being ripped off, the castable concrete is sometimes ripped off with the tile. It might be mechanically bonded to it, in particular by filling the slots receiving the heads 86 of the fixing means.

The metal or non organic fiber grid, disposed between the inner wall 26 of the cooling jacket and the rear face of the tiles, i.e. in the zone into which the castable concrete is then cast, advantageously improves cohesion of the layer of concrete and retains it locally if one or more tiles are ripped off or unhooked. Alternatively or in addition to the grid, the castable concrete may advantageously be reinforced with fibers, preferably metal fibers, mixed with its other constituents during preparation thereof.

After casting the concrete, a flexible mortar is disposed in the expansion spaces separating the tiles to form an expansion joint. The expansion joint thus has a width $e_h$ on its horizontal portions and a width $e_l$ on its vertical portions. Flexible mortars conventionally include ceramic fibers. An example that may be mentioned is Fiberfax® produced by Unifrax.

When the gasifier 5 is operational, variations in heat in the reactor 14 provoke expansion of the tiles. The spacing of the tiles relative to each other, however, allows them to expand without generating high mechanical stresses.

The expansion joint compresses under the effect of the expansion, then regains its initial form when the tiles contract again. At any time during a thermal cycle, the inner wall of the cooling jacket of the reactor thus remains effectively protected.

If the expansion joint is damaged, the shape of the tiles or the presence of plugs 74 (FIGS. 4 to 8) advantageously prevents the materials contained in the reactor having any direct access to the concrete reactor and to the inner wall of the cooling jacket.

Finally, if a tile unhooks, the castable concrete still maintains a protective barrier for the jacket 22. This barrier is safer if a grid has been provided between the wall 26 of said jacket and the tiles, and if the concrete is reinforced with fibers.

Figure 13:
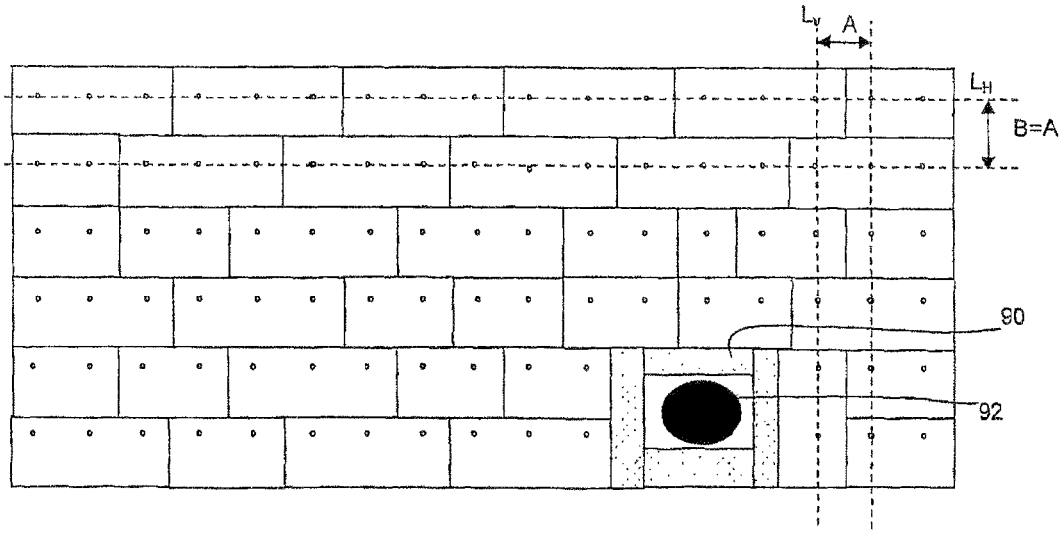
FIG. 13 is a front view of an assembly of tiles of different formats in accordance with the invention. This assembly is cylindrical and is shown in a developed form.

All of the tiles of the assemblies shown in FIGS. 11 and 12 are identical. As can be seen in FIG. 13, a mixture of different tiles may be advantageous, however, in particular to allow the tile assembly to surround an obstacle 92 as closely as possible, and to limit the zones of the lining that are constituted by the filler concrete 90.

As can clearly be seen here, in the preferred implementation, the invention provides a refractory thermally insulating lining that is resistant to corrosive gas, that is of low bulk, that is easy to dismantle, and that has increased reliability. This lining is particularly suitable for protecting the jacket of a gasifier reactor.

Clearly, the present invention is not limited to the above-described and shown implementations that are provided by way of non limiting illustration.

In particular, it is possible to provide a plurality of superimposed slots in a single tile so as to be able to vertically offset two side-by-side tiles and thus avoid a continuous alignment of the horizontal joints. The tiles are preferably mounted in a vertical staggered pattern, all of the tiles of one column being offset relative to the tiles of the two columns that are adjacent to it.

Further, the tiles of the invention are not limited to lining the water jackets of gasifiers.

Further, the tongues 72, the plugs 74, the hiding of the slots on the lower edge of the tiles, the grid, the castable concrete, and the arrangement of the fixing means shown in FIG. 11 are optional. The numbers of tongues, plugs 74, and slots is not limiting.

Finally, the slots that form the suspension points do not constitute the only possible fixing points. Any point of the tile of the invention serving as a point for supporting fixing means may be considered to be a fixing point.

The invention claimed is:

1. A refractory tile for protecting the inner wall of a gasifier reactor, said tile having an alignment of at least two fixing points, any two adjacent fixing points of said alignment being spaced by a constant distance A, first and last fixing points of said alignment being separated, in the direction of said alignment, by distances $\alpha_1$ and $\alpha_2$ from first and second edges of said tile extending in the proximity of said first and last fixing points respectively, wherein $A-(\alpha_1+\alpha_2)$ is in the range 2 mm to 10 mm and wherein said fixing points are slots.

2. The refractory tile according to claim 1, wherein, in a service position of the tile, said alignment is vertical or horizontal.

3. The refractory tile according to claim 1, including at least one slot opening exclusively onto a rear face of said tile.

4. The refractory tile according to claim 1, including at least one slot opening via a lower opening onto a lower edge of said tile, and at least one tongue at least part of which may be introduced via a lower opening of a slot of another identical tile.

5. The refractory tile according to claim 1, wherein on a rear face, the tile has at least one spacer which extends over only a portion of the height H of said tile.

6. The refractory tile according to claim 1, including upper and lower edges having upper and lower lips respectively extending to prolong the front and rear faces of said tile.

7. The refractory tile according to claim 1, made of a material comprising at least 60%, as a percentage by weight, of non-siliceous oxides.

8. The refractory tile according to claim 1, made of a material including less than 1% by weight of silica ($SiO_2$).

9. A refractory lining for protecting the inner wall of a gasifier reactor, said lining comprising an assembly of refractory tiles attached to fixing means fixed to a wall, the lining comprising at least one tile according to claim 1.

10. The lining according to claim 9, wherein a first tile of the lining is spaced from at least one second tile disposed to its right or its left by a distance $e_l$ of $A-(\alpha_1+\alpha_2)$ and/or is spaced from at least one third tile disposed above or below it by a distance $e_h$ of $A'-(\alpha_1'+\alpha_2')$ in which A and A' denote the spacing of any two said fixing points of a horizontal alignment and a vertical alignment of said first tile respectively, $\alpha_1'$ and $\alpha_2'$ designate the distance separating the first and last fixing points of said vertical alignment from upper and lower edges of said first tile respectively, and $\alpha_1$ and $\alpha_2$ designate the distance separating the first and last fixing points of said horizontal alignment from the right and left edges of said first tile respectively.

11. The lining according to claim 9, wherein a castable refractory concrete is disposed along the rear faces of the tiles of the assembly.

12. The lining according to claim 9, wherein at least some of the tiles are mounted in a vertical and/or horizontal staggered pattern.

13. A refractory lining for protecting the inner wall of a gasifier reactor, said lining comprising an assembly of refractory tiles attached to fixing means fixed to a wall, the lining comprising at least one tile according to claim 2.

14. A refractory lining for protecting the inner wall of a gasifier reactor, said lining comprising an assembly of refractory tiles attached to fixing means fixed to a wall, the lining comprising at least one tile according to claim 3.

15. A refractory lining for protecting the inner wall of a gasifier reactor, said lining comprising an assembly of refractory tiles attached to fixing means fixed to a wall, the lining comprising at least one tile according to claim 4.

16. A refractory lining for protecting the inner wall of a gasifier reactor, said lining comprising an assembly of refractory tiles attached to fixing means fixed to a wall, the lining comprising at least one tile according to claim 5.

17. A refractory lining for protecting the inner wall of a gasifier reactor, said lining comprising an assembly of refractory tiles attached to fixing means fixed to a wall, the lining comprising at least one tile according to claim 6.

18. A refractory lining for protecting the inner wall of a gasifier reactor, said lining comprising an assembly of refractory tiles attached to fixing means fixed to a wall, the lining comprising at least one tile according to claim 7.

19. The refractory tile according to claim 1, comprising a spacer extending so as not to impede movement of a concrete cast behind the tile.

20. The refractory tile according to claim 1, having a generally curved shape.

21. The lining according to claim 11, wherein said castable refractory concrete is based on $Al_2O_3$ or $Al_2O_3$—$Cr_2O_3$ or has a nature similar to the tiles.

22. The lining according to claim 11, wherein said castable refractory concrete fills said slots.

23. A gasifier reactor comprising a wall protected by a lining according to claim 10.

24. The gasifier reactor according to claim 23, wherein said wall is free of any tubes.

25. The gasifier reactor according to claim 23, wherein a rear face of each said tile facing said wall is generally flat.

* * * * *

UNITED STATES PATENT AND TRADEMARK OFFICE

CERTIFICATE OF CORRECTION

PATENT NO. : 8,601,959 B2
APPLICATION NO. : 11/908005
DATED : December 10, 2013
INVENTOR(S) : His et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1617 days.

Signed and Sealed this
Twenty-second Day of September, 2015

Michelle K. Lee

Michelle K. Lee
*Director of the United States Patent and Trademark Office*